US005528880A

United States Patent [19]

Landolt

[11] Patent Number: 5,528,880

[45] Date of Patent: Jun. 25, 1996

[54] PROCESS FOR THE PACKAGING OF PRODUCT UNDER VACUUM AND VACUUM-PACKAGING MACHINE

[75] Inventor: Bruno Landolt, Herisau, Switzerland

[73] Assignee: Inauen Maschinen AG, Herisau, Switzerland

[21] Appl. No.: 190,063

[22] PCT Filed: May 14, 1993

[86] PCT No.: PCT/CH93/00122

§ 371 Date: Mar. 15, 1994

§ 102(e) Date: Mar. 15, 1994

[87] PCT Pub. No.: WO93/23289

PCT Pub. Date: Nov. 25, 1993

[30] Foreign Application Priority Data

May 15, 1992 [CH] Switzerland ..... 1563/92

[51] Int. Cl.[6] ..... B65B 31/02; B65B 31/04

[52] U.S. Cl. ..... 53/432; 53/512; 53/434

[58] Field of Search ..... 53/432, 434, 510, 53/512, 52; 73/700

[56] References Cited

U.S. PATENT DOCUMENTS

| | | | |
|---|---|---|---|
| 3,928,938 | 12/1974 | Burrell | 53/512 |
| 4,027,707 | 6/1977 | Maskell . | |
| 4,132,048 | 6/1979 | Day | 53/434 |
| 4,541,224 | 9/1985 | Mugnai | 53/512 |
| 4,583,347 | 4/1986 | Nielsen | 53/434 |
| 4,684,842 | 8/1987 | Maruno et al. | 73/700 |
| 4,922,686 | 5/1990 | Segota | 53/434 |
| 5,155,971 | 10/1992 | Zopf | 53/432 |

FOREIGN PATENT DOCUMENTS

| | | |
|---|---|---|
| 2409716 | 9/1975 | Germany . |

*Primary Examiner*—John Sipos
*Assistant Examiner*—Rodney Butler
*Attorney, Agent, or Firm*—Jacobson, Price, Holman & Stern

[57] ABSTRACT

A vacuum-packing machine has a vacuum chamber (1), a stop valve (10) arranged between the vacuum chamber and a vacuum pump (13), a vacuum sensor (17) connected to the vacuum chamber and an indicator (22) for the negative pressure in the vacuum chamber. An electronic circuitry (21) is connected between the vacuum sensor (17) and the indicator (22) and is designed in such a way that the electric voltage supplied thereto by the vacuum sensor (17) is converted into a continuous series of rectangular pulses. Evacuation of the chamber (1) is stopped when a predetermined pulse frequency or a deviation from a linear course of an evacuation curve is detected. Closure of the package in a vacuum can be closely adapted to the product concerned.

19 Claims, 1 Drawing Sheet

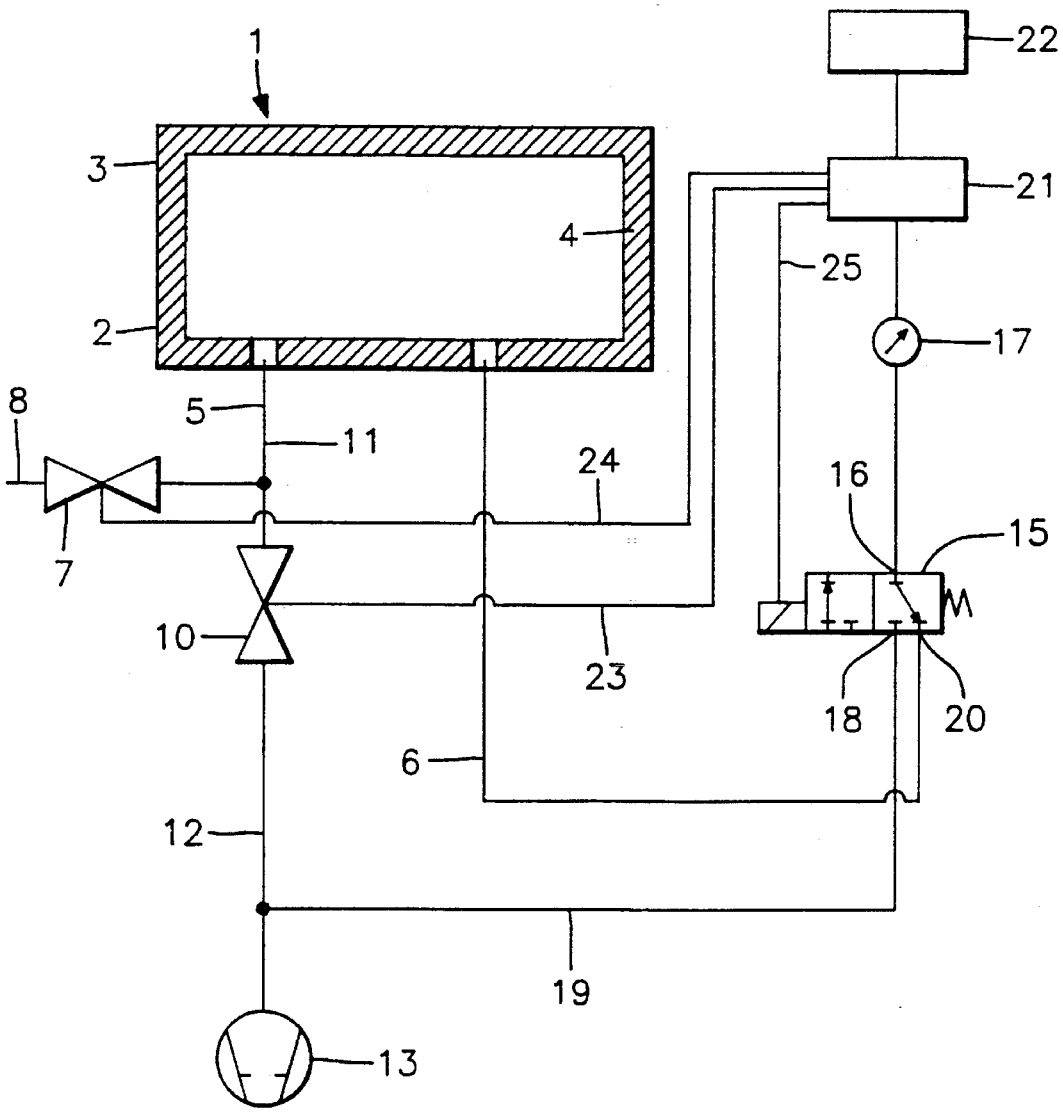
1
2
3
4
5
6
7
8
10
11
12
13
15
16
17
18
19
20
21
22
23
24
25

PROCESS FOR THE PACKAGING OF PRODUCT UNDER VACUUM AND VACUUM-PACKAGING MACHINE

The present invention relates to a process for the packaging of product under a vacuum, in which the product, which is located in a still open wrapper, is introduced into the interior of a vacuum chamber, in which the chamber is then evacuated, and in which the evacuation is terminated and the wrapper of the product is closed as soon as the desired negative pressure has been reached.

In known vacuum-packaging machines, the evacuation of the interior of a vacuum-packaging chamber is terminated after a time span has elapsed. Thereafter, the pack containing the product to be packaged is closed, and the machine can then be opened and the sealed product extracted from the latter.

In the known packaging machines, the end of the evacuation of the packaging chamber is brought about, for example, in that the packaging space is evacuated during a specific previously determined and set time span. The length of this time span is derived from the experience of the person operating the machine. However, considerable problems can arise here. One of these problems is related to the fact that the product to be packaged contains moisture. At the same time, it can quite easily happen that different pieces of the same product to be packaged, for example of meat, have different quantities of moisture. After most of the air has been sucked off from the packaging space, moisture begins increasingly to escape from the product to be packaged. This moisture is likewise sucked off from the vacuum chamber as vapor by means of the vacuum pump. Although the vacuum in the packaging space has already reached the necessary value, because the vacuum pump still continues to run, moisture is still extracted from the product. The latter continues to lose weight during the further running of the pump, and this is undesirable.

In the abovementioned known method of evacuation, there is virtually no possibility of taking into account properties of that particular piece of product to be packaged which is located in the machine.

The object of the present invention is to indicate a process, in which the end of the evacuation can be brought about in dependence on the properties of the particular piece of product to be packaged which is located in the machine.

In the process of the generic type mentioned in the preamble, this object is achieved, according to the invention, as defined in a characterizing clause of claim 1.

A packaging machine for carrying out this process is defined in claim 7.

Embodiments of the present invention are explained in more detail below by means of the accompanying drawing. This drawing shows diagrammatically a machine for carrying out the present process.

The accompanying drawing shows diagrammatically one of the machines, by means of which the present process can be carried out. This machine comprises a vacuum chamber 1 which has a bottom part 2 and a top part 3. The bottom part 2 is stationary and the top part 3 can be articulated on the bottom part 2, for example in the manner of a lid. The bottom part 2 and the top part 3 can be of approximately dish-shaped design. A gasket 4 is located between the end edges of the side walls of the bottom part 2 and of the top part 3, so that a vacuum can be built up in such a chamber 1.

Connected to the interior of the vacuum chamber 1 are, at one end, a working line 5 and a measuring line 6. Connected to the portion 11 of the working line 5 directly adjacent to the vacuum chamber 1 is the outlet of a ventilating valve 7, the inlet 8 of which opens into the surrounding atmosphere. A shut-off valve 10 is interposed in the working line 5, specifically in such a way that one of the orifices of this valve 10 is connected to the first portion 11 of the working line 5. The opposite orifice of the shut-off valve 10 is connected, via a second portion 12 of the working line 5, to a vacuum pump 13. The latter can, for example, be a rotary-slide vacuum pump.

The machine comprises, furthermore, a three-way valve 15. The reversible connection 16 of this valve 15 is connected to a vacuum sensor 17. One of the connectable connections 18 of the directional valve 15 is connected to the vacuum pump 13 via a line 19. The other end of the measuring line 6 is connected to the second of the connectable connections 20. For the description of the actual mode of operation of the present machine, it is assumed that the slide of the directional valve 15 is located in a position, in which the reversible connection 16 of the valve 15 is flow-connected to the second connectable connection 20 of the directional valve 15. This position of the slide of the directional valve 15 is shown in the accompanying drawing. The valve slide is located in its right-hand position. In this position of the valve slide, the vacuum sensor 17 is connected to the measuring line 6 and therefore also to the interior of the vacuum chamber 1.

The vacuum sensor 17 is a piezo-resistive cell which measures the absolute pressure relative to the vacuum. At 0 bar, that is to say in the case of an absolute vacuum, the measuring cell 17 supplies the voltage of 0 mV. At ambient pressure, that is to say at approximately 1 bar, the measuring cell 17 supplies a voltage of approximately 100 mV. This voltage is a direct voltage, the magnitude of which depends, as stated, on the magnitude of the measured negative pressure.

Connected to the electrical output of the vacuum sensor 17 is an electronic circuit arrangement 21 which is indicated diagrammatically merely as a block in the accompanying drawing. Connected to the measuring output of this circuit arrangement 21 is an indicator unit 22 which indicates the magnitude of the vacuum in the form of numerals. A line 23 serving for actuating the shut-off valve 10 is connected to one of the working outputs of the circuit arrangement 21. A further line 24 connected to a corresponding output of the circuit arrangement 21 serves for actuating the ventilating valve 7. The directional valve 15 too can be controlled by the circuit arrangement 21 via a line 25, this line 25 being connected to a respective output of the circuit arrangement 21.

In order to close product to be packaged, the latter is wrapped in a wrapper made of a material closable by welding, and this still open pack is introduced into the interior of the vacuum chamber 1, in such a way that the side tabs of the packaging material are located between welding bars of the vacuum chamber 1. The vacuum chamber 1 is then closed and evacuated. After the vacuum has reached the desired value in the vacuum chamber 1, the welding appliance is activated and the pack is closed in the vacuum chamber 1. Atmospheric pressure can thereafter be restored in the vacuum chamber 1, so that the vacuum chamber 1 can be opened, emptied and loaded with new product to be packaged which is to be closed.

In the circuit arrangement 21, inter alia electrical voltage emitted continuously by the vacuum sensor 17 is converted into a continuous train or series of rectangular pulses. This pulse train thus has a specific frequency. The said conversion takes place in such a way that the frequency of the pulses is proportional to the magnitude of the output voltage of the vacuum sensor 17 and therefore also to the absolute pressure. If the magnitude of the output voltage from the vacuum sensor 17 changes, then the frequency of the pulse train also changes correspondingly. Such pulse trains are transmitted to further portions of the circuit arrangement 21, where they are evaluated and where they can be used to control the mode of operation of the machine.

The memory of circuit arrangement 21 stores values which correspond to the individual values of the negative pressure in the vacuum chamber 1. These values are stored as indications of frequencies which correspond to the individual values of the negative pressure.

The time windows Z or gate times are generated in the circuit arrangement 21. These constitute time segments, during which pulse trains are transmitted in the circuit arrangement 21. The circuit arrangement 21 is also designed so that the length of these time windows or gate times can be changed.

The time windows or gate times are generated at time intervals T. Furthermore, the circuit arrangement 21 is designed so that the time interval T between two successive time windows can be changed.

The number of pulses of the respective frequency which are transmitted during the respective time window serves inter alia for indicating the magnitude of the negative pressure in the vacuum chamber 1.

The conversion of the output voltage of the vacuum sensor 17 into a pulse train, the frequency of the respective pulse train being in a specific relation to the magnitude of the vacuum in the chamber 1, allows at least two methods of evacuation of the chamber 1, in which the termination of the evacuation allows closer reference to that particular piece of product to be packaged which is located in the vacuum chamber 1. In the first method of evacuation, the chamber 1 is evacuated until a predetermined desired value of the negative pressure is achieved in the latter. In the second method of evacuation, the chamber 1 is evacuated until moisture or vapors begin to rise out of the product to be packaged.

In the first method of evacuation, the vacuum value at which evacuation is to be terminated is selected as a comparative value or as a comparative frequency from the memory of the circuit arrangement 21 and is fixed. During the evacuation, the frequency of the pulse series obtained from the signal supplied by the vacuum sensor 17 is compared with the selected value for the comparative frequency in the circuit arrangement 21. As soon as the signal emitted by the vacuum sensor 17 has a frequency which is equal to the comparative frequency, the evacuation is stopped.

Those circuits in the circuit arrangement 21 which perform the said signal conversion are followed by that circuit in which the time windows Z are generated. In the present regard, the time interval T between two successive time windows Z is of no particular importance. The time windows Z are necessary, so that samples of the signal emitted by the vacuum sensor 17, which are to be tested, can be obtained. The test circuit can contain, for example, counters. In these circuits, the frequency of the signal sample transmitted during the time window Z is compared with the comparative frequency. If the frequency of the transmitted signal pattern is equal to the comparative frequency, this means that the preselected vacuum has been reached in the chamber 1, and that the evacuation of the chamber 1 can be stopped via the line 23. The shut-off valve 10 is closed, with the result that the chamber 1 is uncoupled from the vacuum pump 13. The ventilating valve 7 is opened automatically by the circuit arrangement 21 via the line 24. The chamber 1 is filled with air, it can be opened, and so on and so forth.

It was already known to couple the termination of the evacuation of the vacuum chamber to the reaching of a specific value of vacuum in the vacuum chamber. However, a relatively simple vacuum sensor having a direct effect on the remaining parts of the packaging machine was used for this purpose. In this previously known machine, the evaluation of the output signal of the vacuum sensor was relatively rough, and therefore the moment when the evacuation was stopped was subject to a broad spread. In the conversion of the output voltage of the vacuum sensor 17 to a pulse train, as is the case in the present subject, the frequency of this pulse train moreover still being in the kHz range, the value of the vacuum in the chamber 1 can be recorded relatively accurately. Furthermore, the said conversion allows a relatively simple and reliable evaluation of this signal.

The second method of evacuation is based on the knowledge that the pressure in the vacuum chamber 1 first decreases virtually continuously during the evacuation of the latter, when only air alone is sucked off from the vacuum chamber 1. When most of the air has been sucked off from the vacuum chamber 1 and therefore also from the still open pack, the moisture begins to escape from the material of the product to be packaged or to evaporate on the surface of the product. It is known from experience that the quantity of vapor forming from the moisture is different from the quantity of air hitherto sucked off from the vacuum chamber 1. The generation of vapor proceeds relatively quickly, so that, when vapor forms, the pressure in the chamber 1 decreases more slowly than when air alone is being sucked off. Consequently, during the escape of moisture from the product, the pressure in the chamber 1 no longer decreases continuously and not as quickly as hitherto.

In the present case, at the start of the pumping operation, the pressure in the vacuum chamber 1 first decreases virtually linearlly, when only air is sucked off from the chamber 1. This segment of a pumping curve is virtually linear, and it has a specific slope. After most of the air has been sucked off from the chamber 1, vapour begins to escape from the product to be packaged, the result of this being that the slope of the pumping curve becomes smaller than before during this pumping phase. Such a trend of the pumping curve can be monitored by means of electronic circuits.

In the present case too, the samples of the signal emitted by the vacuum sensor 17 pass from the latter, during the time windows Z, to the test circuits where the frequency of the signal sample is determined. These test circuits are supplemented by circuits which can store the result of the test of a signal sample, until the test of the subsequent signal sample is concluded. The results of the test of these two signal samples are then compared with one another, in order to determine the difference in frequency between these two signal samples. This difference indicates the slope of the respective segment of the pumping curve. As long as the successive differences are equal to one another, the virtually linear segment of the pumping curve is concerned, that is to say only air is sucked off. As soon as the difference between two signal evaluations is smaller than the difference previously determined, the pumping curve flattens, and this means that now only vapour and moisture is extracted from the product. The evacuation can be stopped, this being carried out in the way already described above.

As already stated, the frequency of the pulses, which are generated in the circuit arrangement 21 as a result of the voltage emitted by the vacuum sensor 17, depends on the magnitude of the negative pressure in the vacuum chamber 1. The decrease of pressure in the vacuum chamber 1 causes the frequency of the pulses to drop with decreasing pressure. This means that the number of pulses per unit time drops. This means, furthermore, that a decreasing number of pulses is transmitted during the time window of constant length when the pressure in the vacuum chamber 1 drops, that is to say the frequency of the pulse trains decreases.

The said deviations from the initially constant decrease of pressure in the vacuum chamber 1 are very slight, and they can scarcely be indicated by the vacuum sensor 17 in such a way that these deviations could be used directly in order to control the work of the machine. As stated, the frequency of the pulses which are generated as a result of the output voltage from the vacuum sensor 17 is relatively high. It is in the kHz range. This means that a relatively large number of pulses corresponds to a relatively small change of negative pressure in the vacuum chamber 1. This considerable number of pulses can be detected relatively easily by the said circuits and can be used to control the mode of operation of the machine.

When the said deviation from the constant decrease of the pulse frequency is detected in the circuit arrangement 21, this is interpreted as meaning that the vacuum chamber 1 is empty of air and that only moisture would still be extracted from the product if the vacuum pump 13 were to be allowed to continue to run. The circuit arrangement 21 is designed so that, via its outputs, it causes the welding appliance to weld the product pack, so that it terminates the further evacuation of the vacuum chamber 1, and so that it initiates or even executes measures which allow the vacuum chamber 1 to be opened and emptied. For this purpose, for example the shut-off valve 10 is reversed via the line 23, so that the vacuum chamber 1 is uncoupled from the vacuum pump 13. Thereafter, the ventilating valve 7 can be opened by the circuit arrangement 21, after which the vacuum cheer 1 can be opened and emptied.

After the vacuum chamber 1 has been filled with new product to be packaged, it is closed again. The ventilating valve 7 too is closed, whilst the shut-off valve 10 is opened. The vacuum chamber 1 is thereby connected to the vacuum pump 13 again, and once more a constant decrease of pressure in the vacuum chamber 1 first takes place. A further packaging cycle can be carried out in the way described above.

The mode of operation described can be incorporated in the circuit arrangement 21 in the form of individually specified work programs. The operator then need only select a specific program by entering the desired mode of operation of the machine into the latter, for example via a keyboard. This mode of operation is then carried out automatically by the machine.

However, depending on the particular situation, it may be necessary for the evacuation not to be stopped immediately after the occurrence of a flattening in the pumping or vacuum curve, but for it to continue to run for a selectable time span. This is achieved in the simplest way by changing the time interval T between two successive time windows Z. The instruction incorporated in the circuit arrangement can state, for example, that the evacuation is to be terminated when the difference between two successively conducted tests of signal samples amounts to two or fewer units. The difference is always greater than two units in the region of the steep segment of the pumping curve. If the evacuation is to be stopped immediately after the occurrence of the flattening of the pumping curve, then the time span T is selected as short, for example T=0.03 sec. If the evacuation is to run for a further time after the occurrence of the flattening, then the said time span T can even be set at 5 sec.

The pulses transmitted during the time window are converted, in the circuit arrangement 21, into signals which cause a corresponding number to be indicated in the indicator device 22. The numerals 0 or 000 in the indicator device 22 stand for atmospheric pressure in the vacuum chamber 1. The numeral 999 stands for vacuum in the vacuum chamber 1. In the event of an absolute vacuum, the frequency of the measuring pulses amounts to approximately 13 kHz and, at ambient temperature, to approximately 110 kHz. The respective numeral between 0 or 000 and 999 thus corresponds to a specific number of measuring impulses which is transmitted during the time window. If 13 kHz is subtracted from 110 kHz and this result is divided by 999, then, for example, 97 kHz corresponds to a digit between 000 and 999.

Since the indication in the indicator device 22 is coupled to the frequency of the pulse signal from the vacuum sensor 17, it is also possible to follow visually on the indicator device 22 how the magnitude of the vacuum in the vacuum chamber 1 changes.

So that an outstanding quality of the packagings is guaranteed at every moment, measures must be taken to acquire information on the state of the machine which could impair the quality of the packs. This purpose is served by, inter alia, calibrations which are carried out on the machine. There are two types of calibrations which are to be carried out, namely calibration in terms of the magnitude of the ambient pressure and calibration in terms of the maximum obtainable vacuum.

The first type of calibration, in which the magnitude of the ambient pressure is taken into account, takes place with the lid 3 of the vacuum chamber 1 opened. This calibration can be carried out after each switch-on of the machine or else also after each packaging cycle. For this, the vacuum sensor 17 is connected to the interior of the opened vacuum chamber 1 via the directional valve 15, the slide of which is in its right-hand position, and the measuring line 6. The shut-off valve 10 is closed during this, or it is closed for this purpose.

The vacuum sensor 17 supplies an electrical voltage, the magnitude of which is constant, because the pressure in the vacuum chamber 1 is uniform and is equal to the ambient pressure. As a result of the output voltage of the vacuum sensor 17, the circuit arrangement 21 generates a specific number of pulses, this number of pulses being constant, because the pressure is constant. The circuit arrangement 21 automatically ensures the relation between the number of pulses supplied by the vacuum sensor and the numerals 0 or 000 in the indicator device 22. Should the indicator device 22 indicate a different numeral from 000 at the start of this calibration, then the width of the time window T or the magnitude of the gate time is changed by the circuit arrangement 21 itself within the scope of this calibration. If the numeral 000 cannot be obtained in the indicator 22 during a specific time, then it is to be assumed that, for example, the vacuum sensor 17 or the circuit arrangement 21 is defective, and a fault alarm appears.

In the second type of calibration, the maximum obtainable vacuum is determined. This calibration is expediently carried out after each packaging cycle. In order to carry out this calibration, the slide of the directional valve 15 is adjusted in such a way that the reversible orifice 16 of the valve 15 is flow-connected to the first connectable connection 18 of the valve 15. In this case, the vacuum sensor 17 is connected to the vacuum pump 13 via the auxiliary line 19. The shut-off valve 10 is closed during this calibration, so that the vacuum pump 13 is connected only to the vacuum sensor 17. After a few seconds, the line 19 would have to be evacuated as far as the vacuum sensor 17, and after the expiry of this time span the measurement of the vacuum by the vacuum sensor 17 commences.

The maximum vacuum obtainable by a vacuum pump of the type mentioned here can amount to 0.5 mb. The vacuum pump has a still acceptable range over which it is considered still to be good. The limit of this tolerance range can be around 3 to 5 bar. If the vacuum, which is generated during this calibration, does not reach these values, then a fault alarm is emitted.

This calibration of the vacuum pump can be carried out because, as already stated, the values or frequencies corresponding to the individual steps of the vacuum are stored in the circuit arrangement 21. In this calibration, the circuit arrangement 21 compares the signals supplied by the vacuum sensor 17 with the stored vacuum values in the way already described.

In this case too, the circuit arrangement 21 attempts automatically to make the relation between the signals supplied by the vacuum sensor 17 and the numeral 9 or 999 in the indicator device 22. If this is not possible for a few seconds, then a fault alarm is emitted automatically.

The execution of this calibration, although it takes place automatically, takes a few seconds. If the person operating this machine has in the meantime initiated the next packaging cycle, the machine stops the calibration operation automatically. Measured values obtained during the preceding calibration are used for the run of this packaging cycle.

The explanation of the present process made reference to a vacuum-packaging machine for bags. The said bags can, for example, be tubular bags. However, this process can, in practice, be employed in any type of vacuum-packaging machine. In this regard, attention may be drawn, for example, to foil vacuum-packaging machines.

I claim:

1. Process for machine-packaging a product under vacuum comprising the steps of:

(a) introducing the product, in an open wrapper, into the interior of a vacuum chamber to which a vacuum sensor is connected, (b) evacuating the vacuum chamber, during which the vacuum sensor continuously emits an output voltage, the magnitude of which changes in proportion to the negative pressure in the chamber, c) converting the output voltage into a continuous train of rectangular pulses having a pulse frequency proportional to the magnitude of the output voltage, thereby reflecting the magnitude of the vacuum in said chamber, d) monitoring the pulse frequency and comparing it to a stored frequency that corresponds to a desired negative pressure, e) terminating the evacuation when the pulse frequency equals the stored frequency, and f) sealing the wrapper.

2. Process according to claim 1, wherein time windows are generated during which the rectangular pulses are transmitted for comparison with the stored frequency, in that the length of said time windows is variable, and in that the intervals between two successive time windows is variable.

3. Process according to claim 1 wherein the time during evacuation is divided into alternating time windows and intervals, and wherein the pulse frequency is compared with the stored frequency during said time windows.

4. Process according to claim 1, wherein during evacuation pressure change in the vacuum chamber is monitored creating a vacuum curve, and wherein the evacuation is terminated when a deviation from a predetermined vacuum curve has been detected.

5. Process according to claim 1, wherein sealing the wrapper occurs in the vacuum chamber, which is, thereafter, opened and emptied.

6. Process according to claim 1 as a recurring packaging cycle, further comprising first calibration step to determine the magnitude of the ambient pressure, wherein the first calibration is carried out once at the start of a series of packaging cycles or after each packaging cycle.

7. Process according to claim 1 as a receiving packaging cycle, further comprising a second calibration step during which a maximum vacuum in the chamber is determined, wherein the second calibration is carried out before each packaging cycle.

8. Process according to claim 2, wherein the rectangular pulses transmitted during the time windows are converted into signals, which visually show the process results.

9. Process according to claim 4, wherein the train of rectangular pulses is transmitted during time windows of adjustable length and the pulse frequency compound with the stored frequency, and wherein time intervals, which alternate with the time windows, are adjustable.

10. Process according to claim 4, wherein the chamber is evacuated when the vacuum curve is linear and has a first slope, wherein the evacuation is terminated when said vacuum curve lessens in slope, and wherein the slope of the vacuum curve is monitored by an electronic circuit.

11. Process according to claim 10, wherein pulse frequencies of the rectangular pulses transmitted during successive time windows are compared with one another to determine the difference therebetween, which indicates the slope of a respective segment of the vacuum curve, and wherein the evacuation is stopped after said slope of a respective segment smaller than a corresponding slope of the predetermined vacuum curve is detected.

12. Process according to claim 11, wherein the evacuation is adjusted to stop following a time span after the detection of the smaller slope by changing the time interval between two successive time windows.

13. Vacuum-packaging machine for carrying out the process according to claim 1, comprising (a) a vacuum chamber, (b) a shut-off valve between the vacuum chamber and a vacuum pump, (c) a vacuum sensor connected to the vacuum chamber, and (d) an electronic circuit, connected to one end of the vacuum sensor, that (i) converts output voltage emitted by the vacuum sensor into a series of rectangular pulses, whereby the frequency of these pulses is in proportion to the magnitude of the output voltage, (ii) compares the pulse frequency with a stored frequency corresponding to the negative pressure in the vacuum chamber at which the evacuation is to be terminated, and (iii) effects termination of the evacuation when the pulse frequency equals the stored frequency.

14. Vacuum-packaging machine according to claim 13, the electronic circuit comprises a memory, which stores the train of pulses as frequencies, each of which corresponds to individual values of the negative pressure.

15. Vacuum-packaging machine according to claim 13, wherein electronic circuit includes a test circuit comprising counters, which compare the pulse frequency with the stored frequency.

16. Vacuum-packaging machine according to claim 13, wherein the electronic circuit effects measurement of the negative pressure during a time window, and wherein the number of pulses transmitted during said time window indicates the magnitude of negative pressure in the vacuum chamber.

17. Vacuum-packaging machine according to claim 13, wherein the electronic circuit detects whether the pulse frequency changes constantly or not, and wherein the circuit signals the change of the pulse frequency and transmits it to receiving the parts of the machine when the pulse frequency does not change constantly.

18. Vacuum-packaging machine according to claim 13, wherein a working line having first and second ends and a measuring line having first and second ends are connected by their first ends to the vacuum chamber interior, wherein the working line has a first portion and a second portion, between which a shut-off valve is interposed, whereby said first portion includes the first end connected to the vacuum chamber and the vacuum pump is connected to the second portion of the working line comprising the second end, wherein an outlet of a ventilating valve is connected to the first portion and is controlled via a line from a first working output of the electronic circuit, and a shut-off valve is controlled via a line from a second working output of the electronic circuit, wherein the measuring line is connected to a first connector connection of a three-way valve, and a second connector is connected to the vacuum pump via a connector line, and wherein a reversible connector of the three-way valve is connected to an end of the vacuum sensor.

19. Vacuum-packaging machine according to claim 18, wherein an indicator device is connected to a third working output of the electronic circuit, whereby the indicator device visually shows the process result.

* * * * *